United States Patent [19]

Murray

[11] Patent Number: 4,612,711

[45] Date of Patent: Sep. 23, 1986

[54] APPARATUS AND METHOD FOR DRYING PARTICULATE MATERIAL

[75] Inventor: Lawrence K. Murray, Bartlesville, Okla.

[73] Assignee: Phillips Petroleum Company, Bartlesville, Okla.

[21] Appl. No.: 509,540

[22] Filed: Jun. 30, 1983

[51] Int. Cl.[4] ..... F26B 3/24

[52] U.S. Cl. ..... 34/39; 34/134; 34/138; 432/114

[58] Field of Search ..... 34/39, 134, 138, 140, 34/141, 142; 432/112, 113, 114

[56] References Cited

U.S. PATENT DOCUMENTS

| | | | |
|---|---|---|---|
| 856,770 | 6/1907 | Cummer | 34/134 |
| 1,959,061 | 5/1934 | Perkins | 34/6 |
| 3,168,383 | 2/1965 | Loewen | 34/137 |
| 3,219,329 | 11/1965 | Goins | 263/33 |
| 3,251,137 | 5/1966 | Alleman | 34/31 |
| 3,333,344 | 8/1967 | Lowen | 34/31 |
| 3,384,974 | 5/1968 | Alleman et al. | 34/31 |
| 3,824,704 | 7/1974 | Neville | 34/134 |
| 3,852,892 | 12/1974 | Sheehan | 34/134 |
| 4,014,106 | 3/1977 | Bearce | 34/142 |
| 4,031,354 | 6/1977 | D'Souza | 34/142 |
| 4,105,536 | 8/1978 | Morrell | 202/136 |
| 4,205,458 | 6/1980 | Austin | 34/134 |
| 4,393,603 | 7/1983 | Casperson | 34/134 |
| 4,492,043 | 1/1985 | Zannoni | 34/134 |

FOREIGN PATENT DOCUMENTS

| | | | |
|---|---|---|---|
| 1015468 | 9/1957 | Fed. Rep. of Germany | 34/130 |
| 1052096 | 1/1954 | France | 34/134 |

*Primary Examiner*—Albert J. Makay
*Assistant Examiner*—David W. Westphal
*Attorney, Agent, or Firm*—Robert C. Lutton

[57] ABSTRACT

Disclosed is an apparatus for drying particulate material. The apparatus comprises a rotatable drum positioned in an oven. Conduit means positioned in the drum offset from its axis of rotation form flow paths isolated from the inside of the drum leaving from a first portion of the oven to a second portion of the oven. In further aspect, lifting vanes are attached to the inside of the drum and extend generally longitudinally along the interior surface of the drum protruding generally radially inwardly. Catching vanes can be attached to the conduit means to extend generally longitudinally therealong protruding generally radially from the conduit means in a direction generally normal to a radius of the drum.

7 Claims, 3 Drawing Figures

APPARATUS AND METHOD FOR DRYING PARTICULATE MATERIAL

In one aspect, the present invention relates to an apparatus for drying particulate material. In another aspect, the invention relates to a process for drying particulate material. In a still further aspect, the invention relates to process and apparatus for drying wet carbon black pellets.

In the wet pelleting of loose of flocculent carbon black, the wet pellets emerge from the pelleting step containing a substantial amount of water, for example about 50 percent by weight. It is therefore necessary to dry the pellets before storage or shipment. In order to accomplish this the pellets from the pelleting mills are passed through a dryer where they are heated and the water is driven off as a vapor.

One particularly useful type of dryer for drying carbon black is a rotary dryer which generally comprises a drum which rotates about its longitudinal axis within an oven. The drum is usually tilted from the horizontal to cause the carbon black to move along the length of the drum as it is tumbled and agitated by the rotary action of the drum. One or more burners is associated with the oven preferably beneath the rotating drum to provide heat for drying the carbon black.

It is very important that there exists good heat transfer relationship between the gases in the oven and the wet particulate material on the inside of the drum. In certain prior art devices, a portion of the combustion gases from the oven is exhausted into the drum for intimate contact with the wet carbon black in the drum. Usually, the gases introduced into the drum from the oven pass in countercurrent relationship with the carbon black traversing the drum. Disadvantages of this procedure include the possibility of forming an explosive mixture of carbon black dust picked up by the countercurrent flow of gases, the possibility of discharging particulate carbon black emissions into the atmosphere, and the possibility of oxidizing the carbon black in the drum itself due to the contact with the oxidizing combustion gases. Apparatus and method for drying carbon black pellets which avoid these possible problems would be very desirable.

OBJECTS OF THE INVENTION

It is an object of this invention to provide an apparatus for drying carbon black characterized by improved operating efficiency.

It is a further object of this invention to provide an efficient drying apparatus in which intimate contact between the drying gases and the particulate material to be dried is avoided.

It is a further object of this invention to provide an apparatus and a method for drying particulate material which is well adapted for its intended purpose.

SUMMARY OF THE INVENTION

In accordance with one embodiment of the present invention, there is provided an apparatus for drying particulate material. The apparatus is formed by an outer housing having an interior surface. The housing has a first end and a second end. A drum having a first end and a second end is positioned in the housing. An exterior surface of the drum is spaced apart from the interior surface of the housing along a major portion of the length of the exterior surface of the drum. A first chamber is formed between the interior surface of the housing and the exterior surface of the drum. An interior surface of the drum defines a second chamber. Particulate material can be dried in the second chamber in isolation from the volume defined between the housing and the drum. To enhance heat transfer from the outside of the drum to the inside of the drum, a plurality of conduit means are positioned in the drum offset from its axis of rotation and form flow paths isolated from the second chamber leading from adjacent the first end of the housing to adjacent the second end of the housing. By providing a plurality of conduit means offset from the axis of rotation as compared to a single conduit along the axis of rotation, the hot metal surface area available for contact with the particulate material can be increased. Further, by spacing the conduit means well apart from the axis of the drum, the time during which particles are apart from a hot metal surface can be reduced. In a drum dryer, the combustion gases have the highest temperature. The metal surfaces are cooler than the combustion gases. The particulate material is cooler than the hot metal surfaces. To enhance the drying process, the particulate material is kept in contact with the hot metal surfaces to a high extent. Utilizing conduit means offset from the drum axis makes this possible. Heat transfer can be further promoted by providing lifting vanes attached to the interior surface of the drum and catching vanes attached to the conduit means. The vanes increase the hot metal surface area available for drying the particulate material.

According to certain other aspects of the present invention, there is provided a process comprising introducing a particulate material to be dried into the first end of an inclined drum having an upper first end and a lower second end and a mid portion between the first end and the second end. The drum is positioned in an oven having a first end and a second end. The drum is rotated. A first portion of hot gases from the oven is circulated from adjacent the first end of the drum to adjacent the second end of the drum. A second portion of hot gases is circulated through a plurality of tubular members positioned in the drum and connecting to the oven near the first end of the oven and the second end of the oven. The first portion of hot gases and the second portion of hot gases are maintained in isolation from the particulate material. The drying process proceeds with high efficiency which can be further enhanced by lifting the particulate material by rotation of the drum with vanes attached to the inside of the drum and dropping at least a portion of the thus lifted particulate material onto the tubular members for indirect heat exchange with the second portion of hot gases. Dropping the particulate material onto vanes attached to the exterior of the plurality of tubular members further promotes heat exchange in the apparatus.

DETAILED DESCRIPTION OF THE INVENTION

Figure 1:
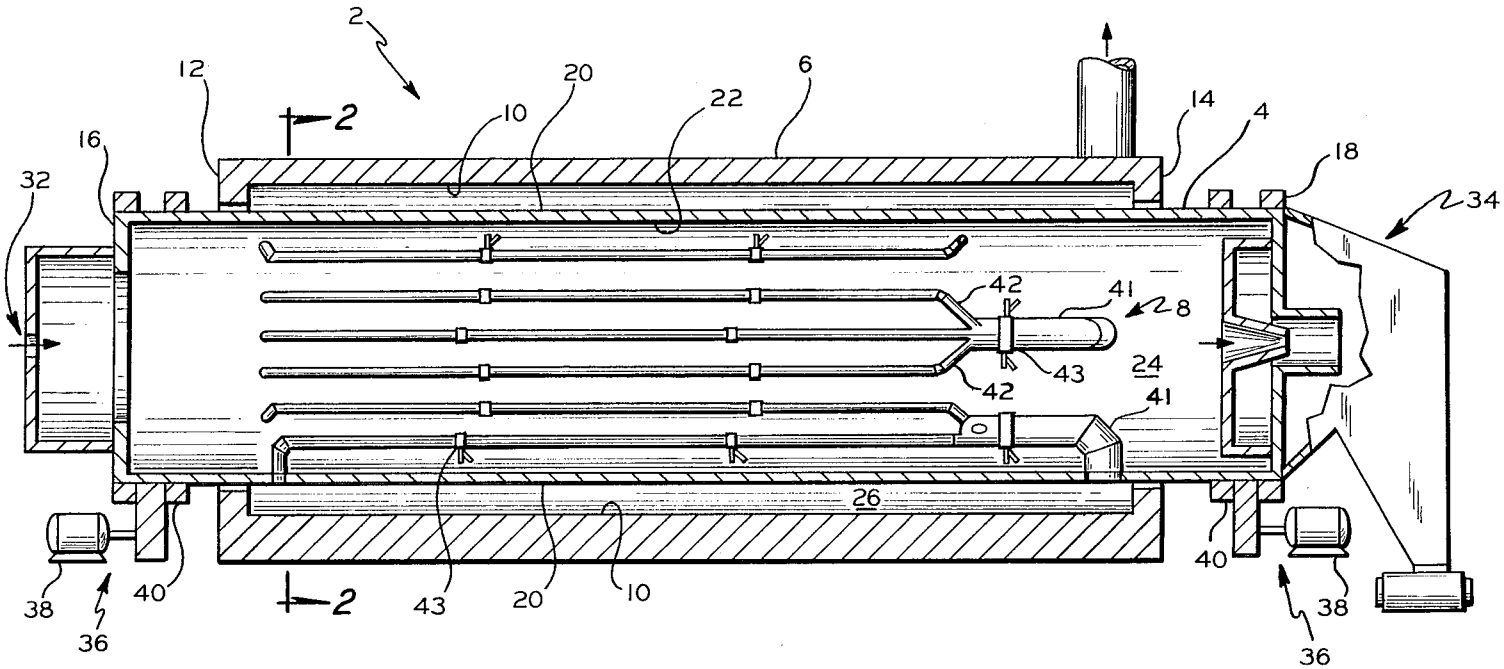
FIG. 1 is a cross-sectional view of a drying apparatus embodying certain features of the present invention.

According to the invention an apparatus 2 for drying particulate material comprises a drum 4 positioned within a housing 6 and a plurality of conduit means 8 positioned in the drum 4. The housing 6 has an interior surface 10, a first end 12 and a second end 14. The drum 4 has a first end 16, a second end 18, an exterior surface 20 and an interior surface 22. A second chamber 24 is defined by the interior surface 22 of the drum 4. A first chamber 26 is defined between the exterior surface 20 of the drum and the interior surface 10 of the housing. The drum 4 is positioned in the housing 6 with the exterior surface 20 of the drum being spaced apart from the interior surface 10 of the housing 6 preferably along a major portion of the length of the exterior surface 20 of the drum 4. Preferably, the exterior surface 20 of the drum 4 is generally cylindrical. If desired, the interior surface 10 can also be generally cylindrical so that a generally annular oven surrounds the drum 4 for a major portion of its length.

A means is associated with the first chamber 26 for supplying hot gases thereto. For example, a first means 28 can be associated with the first chamber 26 adjacent the first end 12 of the housing 6 for introducing hot gases into the first chamber 26. A means is also provided for exhausting hot gases from the first chamber. A second means 30 can be associated with the first chamber 27 adjacent the second end 14 of the housing 6 for exhausting hot gases from the first chamber 26. A means is associated with the second chamber for introducing particulate material thereinto. For example, a third means 32 can be associated with the first end 16 of the drum 4 for introducing the particulate material to be dried into the drum 4. A fourth means 34 can be associated with the second end 18 of the drum 4 for withdrawing dried particulate material from the drum 4. A means 36 is associated with the drum 4 for rotating the drum around its longitudinal axis. Preferably, the means 36 comprises one or more motors 38 driving a track 40 on the exterior of the drum connected to one of the first end 16 and the second end 18 of the drum 4.

Preferably, the plurality of conduit means 8 positioned in the drum 4 are positioned in the drum offset from the axis of rotation of the drum and form paths isolated from the second chamber 24 leading from adjacent the first end 12 of the housing 6 to adjacent the second end 14 of the housing 6. The conduit means 8 are preferably also spaced apart from the inside surface 22 of the drum 4. In an embodiment each conduit means 8 comprises a main line 41 communicating with the first chamber 26 through the wall of the drum 4 adjacent the second end 14 of the housing and a plurality of branch lines 42, each having a smaller inside diameter than the main line 41 and each connecting the main line 41 to the first chamber 26 adjacent the first end 12 of the housing 6. Most desirably, the conduit means 8 will be sufficient in number to provide from about 6 to about 60 flow paths isolated from the second chamber 26 leading through the second chamber from adjacent the first end 12 of the housing 6 to adjacent the second end 14 of the housing 6, more preferably from between about 8 and about 24 such flow paths. Most preferably, the conduit means 8 are positioned generally parallel to the longitudinal axis of the drum 4 and are positioned relatively close to the inside surface 22 of the drum 4. Based on the inside diameter of the drum, it is preferred that the conduit means 8 are positioned at a distance in the range of from about 1/16 to about ¼ drum diameter from the inside surface 22 of the drum 4, usually at about ⅛ of a diameter from the inside surface 22 of the drum 4. The outside of the conduit means is preferably from about 1/16 to about ⅛ diameters apart from the inside of the drum. The conduit means should allow for temperature expansion and gravity and are thus desirably provided with expansion joints such as bellows joints or the like and sliding support fixtures 43 attaching them to the inside surface 22 of the drum 4 along their length.

Figure 2:
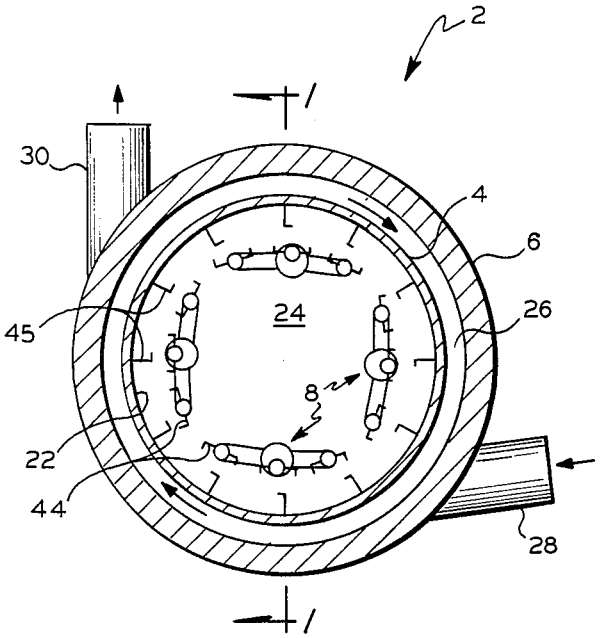
FIG. 2 is a cross-sectional view of the drying apparatus of FIG. 1 when viewed along the indicated lines.
Figure 3:
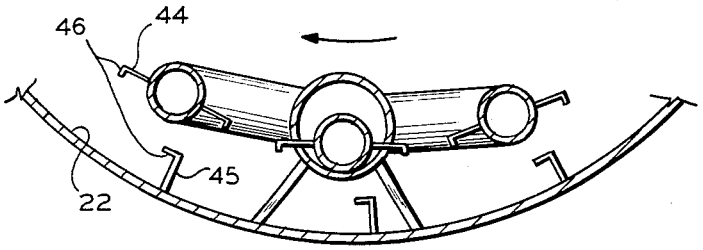
FIG. 3 is a detailed view of a portion of the apparatus as seen in FIG. 2.

With reference to FIGS. 2 and 3, it is further desirable to provide the drum 4 with a first plurality or set of lifting vanes 45 attached to the inside surface 22 of the drum 4. The lifting vanes 45 preferably extend generally longitudinally along the interior surface 22 of the drum 4 and protrude into the second chamber 24 generally radially inwardly. They can be affixed to the drum 4 by any suitable means such as by welding, riveting, bolting or the like. The apparatus is preferably further provided with a second plurality or set of vanes 44 which are attached to the conduit means 8 in the drum 4. These are catching vanes to catch particulate material which pours onto them from the vanes 45. To assist this relationship, the vanes 45 are preferably positioned rotationally or circumferentially spaced apart from the conduit means 8, by which is meant preferably spaced apart from a radius from the longitudinal axis of the drum through the conduit means 8, preferably in the direction in which the drum is to be rotated. The vanes 44 preferably extend generally longitudinally along the conduit means 8 and protrude from the conduit means 8 in a direction generally normal to a radius of the drum 4. Preferably, the vanes 44 protrude from the conduit means 8 generally radially from the conduit means 8. Most preferably, the vanes 44 are attached to the branch lines 42 of the conduit means 8 and protrude generally radially from the branch lines 42 in a direction generally normal to the radius of the drum 4.

To further increase the contact time between the particulate material to be dried and the hot metal surfaces inside the drum, at least one of the vane sets 45 and 44 are preferably provided with a lip 46 extending along its edge. Most preferably, each vane of the vane sets 45 and 44 is provided with a lip 46. Each vane 45 is provided with a lip on its inward edge which extends at about a right angle from the lifting vane 45 in the direction in which the drum is to be rotated by the rotation means 36. At least a portion of the second plurality of catching vanes 44 is provided with a lip 46 on its edge which extends at about a right angle from the catching vane 44 in a direction generally outwardly along a radius of the drum.

According to certain other aspects of the present invention, there is provided a process comprising introducing a particulate material to be dried into the first end 16 of an inclined drum 4 having an upper first end 16 and a lower second end 18 and a mid portion between the first end and the second end which is positioned in an oven which can be defined by the housing 6 having a first end 12 and a second end 14 for example. The particulate material to be dried can have a particle size in the range of from about 200 mesh or less up to about ¼ inch or greater for example. Types of particulate materials which can be dried in this apparatus include crystals, foodstuffs, animal feeds, minerals, pigments, etc. Preferably, carbon black would be dried according to the process, since the invention is believed to be especially well suited for drying carbon black. The drum is rotated and a first portion of hot gases is circulated in the oven around the drum. A second portion of hot gases is circulated through a plurality of tubular members such as tubular members 42 positioned in the drum 4 and connecting to the oven 6 near the first end 12 of the oven and the second end 14 of the oven. The first portion of hot gases and the second portion of hot gases are maintained in isolation from the particulate material passing through the drum 4 in the chamber 24 and heat surfaces of the drum, usually metal surfaces, which in turn heats the particulate.

The temperature of the hot gases circulated will depend upon the type of particulate material to be dried and the agent with which it has been wetted. The temperature of the hot gases should not be so high as to damage the particulate material but must be high enough to provide adequate driving force to evaporate the fluids from the particulate material. The hot gases can be introduced into the oven at a slightly higher temperature where generally concurrent flow of particulate material and hot gases is used, since the hotter gases contact the wetter cooler material and the cooler gases contact the drier particulate material, thus avoiding scorch.

As the particulate material passes through the drum, it is lifted by the action of the drum and falls onto the plurality of tubular members positioned in the drum where it contacts hot metal rather than falling onto cool particulate material in the bottom of the drum as would be the case if the tubular members were not present and positioned so as to catch the particulate material. The process will proceed with higher efficiency where the particulate material is lifted by rotation of the drum with vanes attached to the inside of the drum, such as the vanes 45 which extend generally longitudinally along the inside of the drum. The vanes assist in carrying the particulate material further up the side of the drum and against the hot wall to deliver it onto the tubular members. When the lifting vanes are used, at least a portion of the lifted particulate material is dropped onto the tubular members from the vanes for indirect heat exchange with the second portion of hot gases by direct heat exchange with the hot metal. The drying process can be even further promoted where the particulate material is dropped onto vanes which have been attached to the exteriors of the plurality of the tubular members, such as the vanes 44. The flat surface of the vanes will carry more carbon black than the cylindrical surfaces of the tubular members for direct heat exchange with the hot metal and for a greater time period. Additionally, heat from the second portion of the hot gases is conducted from the inside of the plurality of tubular members into the vanes attached thereto and from there into the particulate material which is heaped onto the vanes. Where the vanes attached to the tubular members extend generally normally to a radius of the drum the particulate material will be carried on the vanes attached to the tubular members for a portion of the rotation of the drum prior to being dropped onto the inside surface of the drum. Most preferably, the particulate material dropped from the vanes attached to the tubular members will fall onto hot metal directly or onto a relatively thin coating of particulate material on the hot metal. This is also preferred for material transferred from the vane 45 and onto the vanes 44 and tubular members 42. In this manner, the residence time of the carbon black against hot metal surfaces as it travels through the drum can be increased. The exterior of the drum can be provided with swinging hammers or the like to prevent a thick coating of particulate from accumulating on the inside of the drum.

The invention is illustrated by the following calculated example:

| Typical Operation (Calculated) [All Parts of Dryer Drum & Conduits, Etc., 316SS] | |
|---|---|
| Rotary Dryer Drum 4: | |
| Diameter, Ft, | 8 |
| Length, Ft, | 65 |
| Wall Thickness, Inches, | $\frac{5}{8}$ |
| Main Hot Gas Outlets 41: | |
| Number, (at 90°), | 4 |
| Diameter, Inches, | 10 |
| Length, Feet, | 11 |
| Small Hot Gas Feeders 42: | |
| Total Number | 12 |
| Diameter, Inches, | 6 |
| Length, Feet, | 38 |
| Lifters 44 on Feeders | 2 |
| Number on Each | |
| Length of Base of L, inches, | 4 |
| Length of Lip 46 of L, inches, | 2.5 |
| Total Length on Feeder, Ft, | 38 |
| Flights 45 on Inner Periphery of Drum: | |
| Radial Length, Inches, | 4 |
| Lip 46 Length, Inches, | 2.5 |
| Peripheral Spacing, Degrees | 20 |
| Axial Length, Ft, | 45 |
| Rotation of Drum, RPM, (Varidrive) | 2.0 to 5.0 |
| Normal | 3.5 |
| Wet C.B. Pellets Charged: | |
| Lbs./Hr, | 17,296 |
| Wt % Water, | 47 |
| Dried C.B. Pellets Out: | |
| Lbs./Hr, | 9,259 |
| Wt. % Water (Max) | 1.0 |

Compared with dryers without my invention's heaters with lifters, the invention will process about 30% more of the same pellets to the same dryness than without inventive features (same wt.% water in wet pellets; same wt.% water in dried pellets).

Prior operation without my invention can process about 12,970 lbs/hour of wet pellets from 47% (wt) water to 1% (wt.), the dried pellets being 6,944 lbs/hr.

What is claimed is:

1. An apparatus for drying particulate material, said apparatus comprising:

(a) a housing having an interior surface, a first end and a second end;

(b) a drum having a first end, a second end, and a sidewall having an exterior surface and an interior surface, said drum being positioned in the housing with the exterior surface of the drum spaced apart from the interior surface of the housing along a major portion of the length of the exterior surface of the drum defining a first chamber, the interior surface of the drum defining a second chamber; and (c) a plurality of generally longitudinally extending conduit means positioned in the drum offset from its axis of rotation at a distance of about 1/16 to about $\frac{1}{4}$ of a drum diameter from the interior surface of the drum forming flow paths isolated from the second chamber leading from adjacent the first end of the housing to adjacent the second end of the housing, and conduit means communicating with the first chamber through the sidewall of the drum, and (d) a first plurality of vanes attached to the conduit means positioned in the drum, said first plurality of vanes extending generally longitudinally along the conduit means and protruding generally radially from the conduit means with at least a majority of the conduits having said vanes extending in a direction generally normal to a radius of the drum, for catching particulate material dropped on them.

2. An apparatus as in claim 1 further comprising a second plurality of vanes attached to the interior surface of the drum and extending generally longitudinally and continuously along the interior surface of the drum and protruding into the second chamber generally radially inwardly for lifting particulate material, each having a lip on its inward edge which extends at about a right angle from the vane in the direction in which the drum is to be rotated, and wherein at least a portion of the first plurality of vanes each has a lip on its edge which extends at about a right angle from the vane in a direction generally outwardly along a radius of the drum.

3. An apparatus as in claim 2 wherein each conduit means comprises:

a main line communicating with the first chamber through the drum adjacent the second end of the housing; and a plurality of branch lines, each having a smaller inside diameter than the main line and each connecting the main line to the first chamber adjacent the first end of the housing.

4. A process comprising:

(a) introducing a particulate material to be dried into the first end of an inclined drum having an upper first end and a lower second end and a mid portion between the first end and the second end positioned in an oven having a first end and a second end;

(b) rotating the drum;

(c) circulating a first portion of hot gases in the oven around the drum;

(d) circulating a second portion of hot gases through a plurality of tubular members generally longitudinally positioned in the drum offset from a longitudinal axis of the drum and connecting to the oven near the first end of the oven and the second end of the oven, said tubular members being spaced apart from an inside surface of the drum at a distance in the range of from about 1/16 to about ¼ of a diameter of the drum, said first portion of hot gases and said second portion of hot gases being maintained in isolation from the particulate material and heating surfaces of the drum;

(e) lifting the particulate material by rotation of the drum with vanes attached to the inside of the drum and extending generally longitudinally along the inside of the drum and dropping at least a portion of the lifted particulate material onto the tubular members for indirect heat exchange with the second portion of hot gases;

(f) dropping at least a portion of the particulate material onto vanes attached to the exteriors of the plurality of tubular members for indirect heat exchange with the second portion of hot gases, a majority of said tubular-mounted vanes being arranged to extend in a direction generally normal to a radius of said drum for catching particulate material dropped on them.

5. A process as in claim 4 further comprising carrying the particulate material on the plurality of vanes attached to the tubular members for a portion of a rotation of the drum and then dropping the particulate material to the inside surface of the drum.

6. A process as in claim 5 further characterized in that most of the particulate material which is dropped lands on heating surfaces of the drum or a relatively thin coating of the particulate material on the heating surfaces of the drum.

7. A process as in claim 6 wherein the particulate material comprises carbon black.

* * * * *